US007866289B2

(12) United States Patent
Grunow et al.

(10) Patent No.: US 7,866,289 B2
(45) Date of Patent: Jan. 11, 2011

(54) CAMSHAFT ADJUSTING DEVICE

(75) Inventors: Lutz Grunow, Berlin (DE); Ulrich Stubbemann, Berlin (DE)

(73) Assignee: Daimler AG, Stuttgart (DE)

( * ) Notice: Subject to any disclaimer, the term of this patent is extended or adjusted under 35 U.S.C. 154(b) by 421 days.

(21) Appl. No.: 12/009,847

(22) Filed: Jan. 22, 2008

(65) Prior Publication Data

US 2008/0149057 A1 Jun. 26, 2008

Related U.S. Application Data

(63) Continuation-in-part of application No. PCT/EP2006/006683, filed on Jul. 7, 2006.

(30) Foreign Application Priority Data

Jul. 22, 2005 (DE) ..... 10 2005 034 276

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS 7,025,023 B2 * 4/2006 Lehmann et al. ..... 123/90.17

FOREIGN PATENT DOCUMENTS

| | | |
|---|---|---|
| DE | 196 54 926 | 11/1997 |
| DE | 198 17 319 | 10/1999 |
| DE | 100 50 606 | 4/2001 |
| DE | 101 61 701 | 6/2001 |
| DE | 101 09 837 | 9/2002 |
| DE | 103 46 443 | 5/2005 |
| DE | 103 56 907 | 7/2005 |

* cited by examiner

*Primary Examiner*—Ching Chang
(74) *Attorney, Agent, or Firm*—Klaus J. Bach

(57) ABSTRACT

In a camshaft adjusting device including a vane cell adjuster component for coupling a camshaft to a crankshaft to be driven by the crankshaft in an adjustable angular relationship, wherein a vane rotor is mounted onto the camshaft by a central hollow clamping bolt including a control valve for controlling the flow of control fluid to and from the vane cells so as to control the relative angular position of the camshaft, an additional fixing means is provided between the vane rotor and the camshaft for assisting a rotationally fixed coupling of the vane rotor with the camshaft.

11 Claims, 2 Drawing Sheets

CAMSHAFT ADJUSTING DEVICE

This is a Continuation-in-Part application of pending international application PCT/EP2006/006683 filed Jul. 7, 2006 and claiming the priority of German Application 10 2005 034 276.0 filed Jul. 22, 2005.

BACKGROUND OF THE INVENTION

The invention relates to a camshaft adjusting device including a vane cell adjuster component with a central control valve for controlling the flow of control fluid to, and from, the vane cells of the camshaft adjusting device.

DE 198 17 319 C2 discloses a camshaft adjusting device which has an adjusting means, which is coupled to a camshaft, and includes an integrated central control valve. The adjusting means is formed by an inner body, which includes vanes which project radially from its outside and are disposed between radially inwardly projecting vanes of an outer body. A central clamping screw extends through the inner body for clamping the inner body axially against the camshaft by means of said clamping screw. The camshaft adjusting device also comprises a slide valve which is integrated into the clamping screw that forms a valve housing.

It is the principal object of the present invention to provide a camshaft adjusting device with low manufacturing costs and a high level of functional reliability.

SUMMARY OF THE INVENTION

In a camshaft adjusting device including a vane cell adjuster component for coupling a camshaft to a crankshaft to be driven by the crankshaft in an adjustable angular relationship, wherein a vane rotor is mounted onto the camshaft by a hollow clamping bolt including a central control valve for controlling the flow of control fluid to and from the vane cells so as to control the relative angular position of the camshaft, an additional fixing means is provided between the vane rotor and the camshaft for assisting a rotationally fixed coupling of the vane rotor with the camshaft.

The "additional fixing means" is to be understood in particular as a means by which the clamping force normally required can be reduced. The additional fixing means can, in addition to a force-fitting action brought about by the clamping means alone, provide a form-fitting engagement, for example by virtue of the additional fixing means being formed by integrally formed toothings, such as by polygonal toothings, one or more roughened surfaces etc. The additional fixing means can generate a materially joined connection, for example by virtue of the additional fixing means being formed by an adhesive which is arranged between the adjusting means and the camshaft. It is particularly advantageous, however, if at least one additional fixing means is formed by a friction-force-increasing means, such as one or more friction-force-increasing coatings, a friction-force-increasing disk and/or advantageously by a friction-force-increasing film, whereby the additional fixing means can be realized in a particularly structurally simple and cost-effective manner. The friction-force-increasing means can preferably be provided to achieve a micro-toothing, for example by virtue of said friction-force-increasing means having splinters which are formed from a harder material than the vane rotor and the camshaft and which dig into the surfaces thereof. It is preferably possible for diamond splinters or also other metallic and/or non-metallic splinters which would appear to a person skilled in the art to be expedient to be used as splinters. In this context, "provided" is to be understood to mean in particular specifically "equipped" and/or specifically "designed". In addition, in this context, a "central valve" is to be understood in particular to mean a valve which is arranged within the adjusting means and comprises in particular at least one movably mounted valve body such as a valve slide and/or a valve ball or spool.

By means of a corresponding design according to the invention, it is possible for clamping forces which are to be applied by the central clamping means to be reduced; undesired deformations, which could in particular have an influence on a movement of the central valve or on a valve slide, can be reliably avoided; and it is possible in particular for materials which can be processed in a cost-effective manner, in particular with relatively low tensile strength values, to be used for the adjusting means and/or the central clamping means. At least the central clamping means can preferably be formed at least partially from a material with a tensile strength of less than or equal to 800 MPa, and/or at least the adjusting means can even be formed at least partially from a material with a tensile strength of less than or equal to 250 MPa. Alternatively, the adjusting means and/or the central clamping means could be formed from materials with relatively high tensile strength values and with relatively low material thicknesses. Cost-effective production can be, obtained in particular if at least the central clamping means and/or at least the adjusting means are formed at least partially from a light metal alloy and/or from a plastic. Here, different alloys, which would appear to a person skilled in the art to be expedient, can be used, preferably aluminum alloys and/or magnesium alloys, as a result of which particularly light components can be obtained which can be produced in a cost-effective manner. Also machining steels can be used for the central clamping means and/or for the adjusting means which are optimized for cutting on automated machine tools, and/or materials which can relatively easily be extruded.

It is also possible to use various plastics, preferably fiber-reinforced and/or particle-reinforced plastics, particularly a phenol-resin-based duroplastic, as a base plastic.

If the adjusting means and the central clamping means are formed at least partially from the same material, it is possible to avoid different thermal expansions in operation and undesired relaxation and/or twisting caused by different materials.

It is also proposed that the central clamping means, in the installed state, bears directly against the adjusting means, as a result of which additional components, installation space, weight, assembly expenditure and costs can be saved.

If the camshaft adjusting device has a securing means which is provided to captively hold the additional fixing means against its carrier component, the carrier component, such as in particular the camshaft and/or particularly preferably the adjusting means itself, can be delivered and/or assembled together with the additional fixing means as a modular unit.

The securing means can be formed by various means which would appear to a person skilled in the art to be expedient, such as by latching, clamping, materially joining and/or form-fitting means. The securing means is however particularly advantageously produced by means of a spraying process or some other coating process, and the additional fixing means is specifically preferably extrusion coated during the manufacture of the adjusting means, as a result of which no additional components are needed for the securing means.

The invention will become more readily apparent from the following description of exemplary embodiments thereof on the basis of the accompanying drawings:

DESCRIPTION OF PARTICULAR EMBODIMENTS

Figure 1:
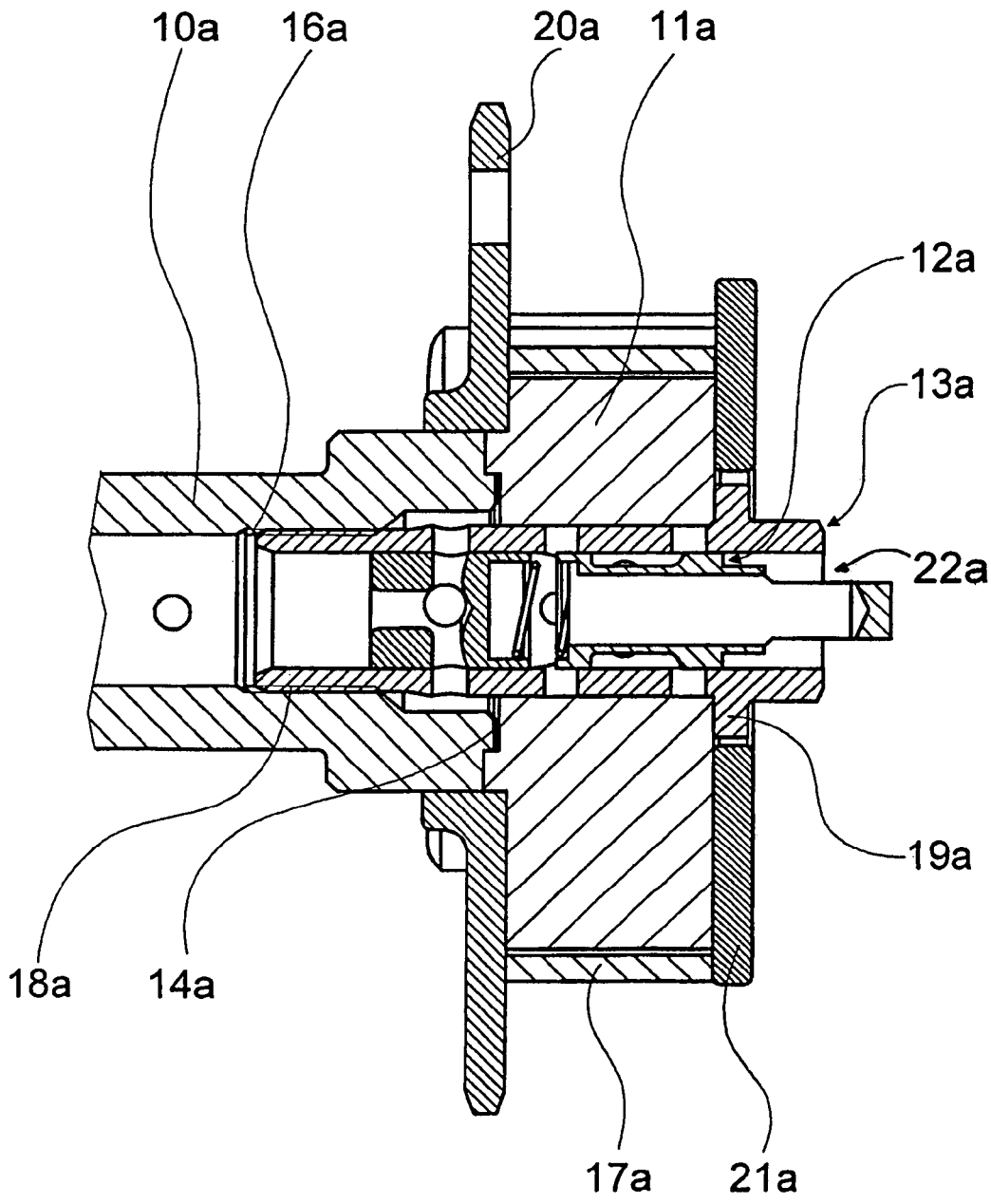
FIG. 1 is a sectional view of a camshaft adjusting device mounted on a camshaft.

FIG. 1 shows a camshaft adjusting device which has an adjusting means 11*a*, which is coupled to a camshaft 10*a* and is formed by a vane piston. It includes a central valve 22*a* with a valve slide 12*a* which is mounted so as to be movable in the axial direction. The camshaft adjusting device also comprises a central clamping means 13*a* which is embodied as a clamping screw and which at the same time forms the valve housing of the central valve 22*a*. The clamping screw 13*a* extends through the adjusting means 11*a* and is screwed with an external thread 18*a* into an internal thread 16*a* of the camshaft 10*a* and presses the adjusting means 11*a* in the axial direction against the camshaft 10*a*. The central clamping means 13*a* bears here with an integrally formed, screw-head-like radial flange 19*a* directly against the adjusting means 11*a*. Arranged between the adjusting means 11*a* and the camshaft 10*a*, specifically between end sides of these, is an additional fixing means 14*a* which is formed by a friction-force-increasing film and which is provided for assisting rotationally fixed coupling of the adjusting means 11*a* to the camshaft 10*a*. The additional fixing means 14*a* includes diamond splinters in order to produce a micro-toothing. The friction increasing film may for example be applied by a spraying process.

The central clamping means 13*a* is arranged concentrically with respect to the adjusting means 11*a* and coaxially with respect to the camshaft 10*a* and serves as a valve housing for the central valve 22*a*. The valve slide 12*a* is mounted so as to be movable in the axial direction in the substantially tubular central clamping means 13*a* and can be actuated in the axial direction by means of an electromagnetic actuator (not shown).

The adjusting means 11*a* which is arranged within a vane cell adjuster housing 17*a* is formed from a light metal alloy, specifically from a magnesium alloy, with a tensile strength of less than 250 MPa, and the central clamping means 13*a* is formed from an aluminum alloy with a tensile strength of less than 800 MPa. The adjusting means 11*a* and/or in particular the central clamping means 13*a* could however also be formed from a machining steel.

The vane cell adjuster housing 17*a* is rotationally fixedly coupled to a sprocket 20*a* which is in turn coupled by means of a chain (not shown) to a crankshaft (not illustrated). The sprocket 20*a* delimits the adjusting means 11*a* and the vane cell adjuster housing 17*a* in the direction of the camshaft 10*a*, while a cover 21*a* delimits the adjusting means 11*a* and the vane cell adjuster housing 17*a* in the direction away from the camshaft 10*a*.

In operation, the sprocket 20*a*, and with the sprocket 20*a*, the vane cell adjuster housing 17*a*, is driven by the crankshaft via the chain. The adjusting means 11*a* and, by way of the adjusting means 11*a*, the camshaft 10*a* is driven by the vane cell adjuster housing 17*a* by means of an oil volume in the vane cells which can be controlled by means of the valve slide 12*a*. The adjusting means 11*a* is mounted so as to be rotatable relative to the vane cell adjuster housing 17*a*, and it is possible to adjust the relative rotational position of the adjusting means 11*a* with respect to the vane cell adjuster housing 17*a*, and therefore the relative rotational position of the crankshaft with respect to the camshaft 10*a* by means of the valve slide 12*a*.

Figure 2:
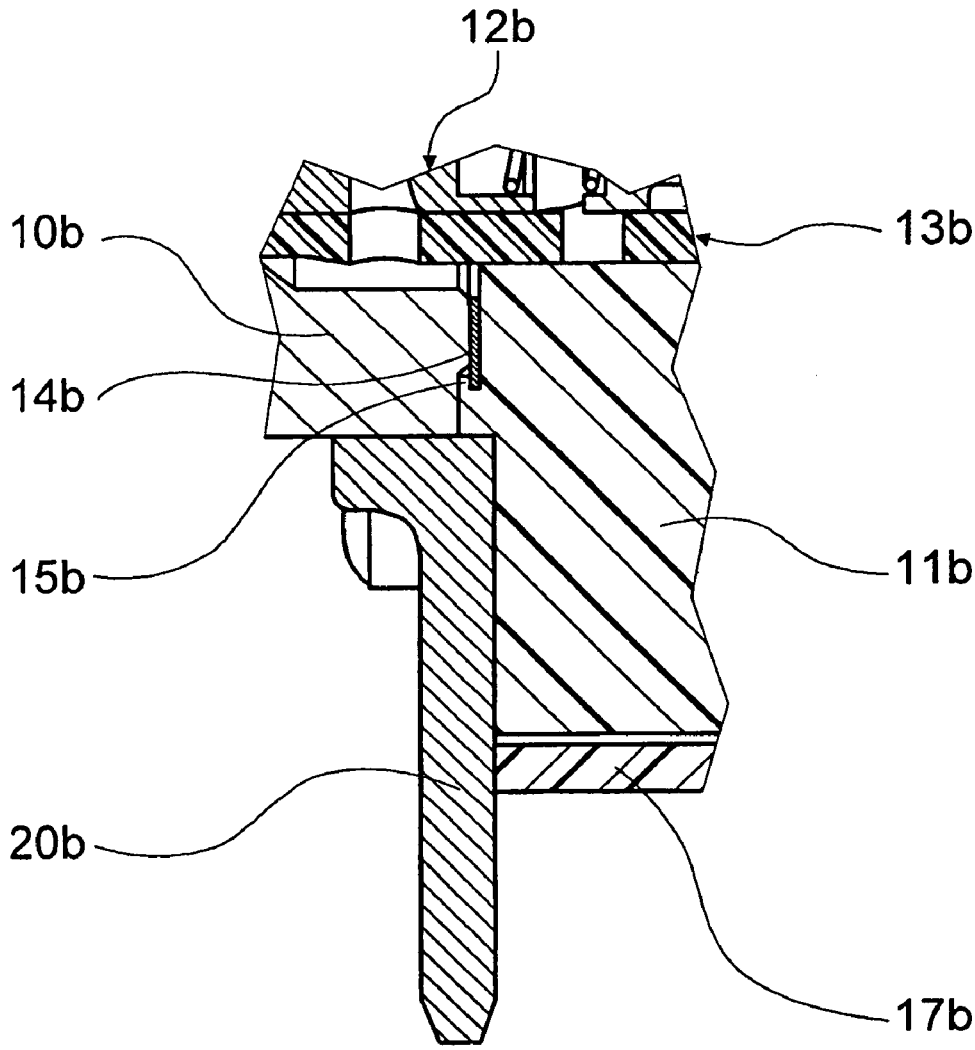
FIG. 2 shows, in a sectional view, a part of an alternative camshaft adjusting device using components consisting of plastic.

FIG. 2 shows a detail of a section illustration of an alternative camshaft adjusting device. Substantially identical components are denoted by the same reference symbols, with the letters "a" and "b" having been added to the reference symbols in order to distinguish the exemplary embodiments. In addition, of identical features and functions, reference can be made to the description with regard to the exemplary embodiment in FIG. 1. The following description is restricted substantially to the differences with respect to the exemplary embodiment in FIG. 1.

The camshaft adjusting device has an adjusting means 11*b* and a central clamping means 13*b* which are both formed by a fiber-reinforced plastic.

The adjusting means 11*b* is produced in an injection molding process, with an additional fixing means 14*b* which is formed by a friction-force-increasing film being extrusion coated during the manufacture of the adjusting means 11*b*, so that securing means 15*b* are formed, by means of which the additional fixing means 14*b* is captively held on the adjusting means 11*b*, and so that the adjusting means 11*b* and the additional fixing means 14*b* can be assembled together as a module.

What is claimed is:

1. A camshaft adjusting device which has at least one vane cell adjuster component (11*a*, 11*b*) coupled to a camshaft (10*a*, 10*b*), comprising a central valve (22*a*, 22*b*) having a central clamping means (13*a*, 13*b*) for clamping the vane cell adjuster component (11*a*, 11*b*) to the camshaft (10*a*, 10*b*) along engagement surfaces thereof for rotation therewith, and an additional friction force increasing means (14*a*, 14*b*) applied to the engagement surfaces for assisting a rotationally fixed coupling of the adjuster component (11*a*, 11*b*) to the camshaft (10*a*, 10*b*).

2. The camshaft adjusting device as claimed in claim 1, wherein at least the central clamping means (13*a*, 13*b*) is formed at least partially from a material with a tensile strength of not more than 800 MPa.

3. The camshaft adjusting device as claimed in claim 1, wherein at least the central clamping means (13*a*) is formed at least partially from a light metal alloy.

4. The camshaft adjusting device as claimed in claim 1, wherein at least the central clamping means (13*b*) is formed at least partially from plastic.

5. The camshaft adjusting device as claimed in claim 1, wherein at least the vane cell adjuster component (11*a*, 11*b*) is formed at least partially from a material with a tensile strength of not more than 250 MPa.

6. The camshaft adjusting device as claimed in claim 5, wherein at least the adjusting means (11*a*) is formed at least partially from a light metal alloy.

7. The camshaft adjusting device as claimed in claim 5, wherein at least the adjusting means (11*b*) is formed at least partially from plastic.

8. The camshaft adjusting device as claimed in claim 1, wherein the central clamping means (13*a*, 13*b*) in the installed state, bears directly against the adjuster component (11*a*, 11*b*).

9. The camshaft adjusting device as claimed in claim 1, wherein a securing means (15*b*) is provided to captively hold the additional friction force increasing means (14*b*) against its carrier component.

10. The camshaft adjusting device as claimed in claim 9, wherein the securing means (15*b*) is produced by means of a spraying process.

11. A method for producing a camshaft adjusting device comprising at least one camshaft adjusting device which has at least one vane cell adjuster component (11*a*, 11*b*) coupled to a camshaft (10*a*, 10*b*) via engagement surfaces thereof, comprising a central valve (22*a*, 22*b*) having a central clamping means (13*a*, 13*b*), and an additional friction force increasing means (14*a*, 14*b*) applied to the engagement surfaces for assisting a rotationally fixed coupling of the adjusting means (11*a*, 11*b*) to the camshaft (10*a*, 10*b*), said method comprising the step of applying the additional friction force increasing means (14*b*) by extrusion coating during the manufacture of the adjusting means (11*b*).

* * * * *